US008827873B2

(12) United States Patent
Arnstein

(10) Patent No.: US 8,827,873 B2
(45) Date of Patent: Sep. 9, 2014

(54) REHABILITATION EXERCISE AID

(76) Inventor: Joel Arnstein, Smarden Kent (GB)

( * ) Notice: Subject to any disclaimer, the term of this patent is extended or adjusted under 35 U.S.C. 154(b) by 78 days.

(21) Appl. No.: 13/511,257

(22) PCT Filed: Nov. 19, 2010

(86) PCT No.: PCT/AU2010/001553

§ 371 (c)(1),
(2), (4) Date: May 22, 2012

(87) PCT Pub. No.: WO2011/063449

PCT Pub. Date: Jun. 3, 2011

(65) Prior Publication Data

US 2012/0232449 A1 Sep. 13, 2012

(30) Foreign Application Priority Data

Nov. 30, 2009 (AU) ..... 2009905850

(51) Int. Cl.

| | |
|---|---|
| ***A63B 21/00*** | (2006.01) |
| ***A61H 1/02*** | (2006.01) |
| ***A63B 23/08*** | (2006.01) |
| *A63B 71/06* | (2006.01) |
| *A63B 71/00* | (2006.01) |
| *A63B 22/00* | (2006.01) |

(52) U.S. Cl.

CPC ..... *A61H 1/0266* (2013.01); *A63B 23/085* (2013.01); *A63B 2071/0625* (2013.01); *A63B 21/1423* (2013.01); *A63B 71/0054* (2013.01); *A61H 2201/0173* (2013.01); *A63B 2022/0094* (2013.01)

USPC ..... 482/79; 482/80; 602/5; 602/16; 602/23; D24/192

(58) Field of Classification Search

USPC ..... 482/79, 80; 602/5, 16, 23, 27, 28, 32, 602/17; D24/192

See application file for complete search history.

(56) References Cited

U.S. PATENT DOCUMENTS

| | | | | |
|---|---|---|---|---|
| 5,394,888 | A | 3/1995 | Stone et al. | |
| 5,792,077 | A | 8/1998 | Gomes | |
| 6,872,187 | B1 | 3/2005 | Stark et al. | |
| 8,475,397 | B2 * | 7/2013 | Chiu et al. | 602/28 |
| 2006/0282018 | A1 | 12/2006 | Balzano | |

FOREIGN PATENT DOCUMENTS

| | | |
|---|---|---|
| FR | 2917594 | 12/2008 |
| WO | 9426359 | 11/1994 |

OTHER PUBLICATIONS

International Search Report from corresponding International Application No. PCT/AU2010/001553.

* cited by examiner

*Primary Examiner* — Jerome W Donnelly
(74) *Attorney, Agent, or Firm* — Renner, Otto, Boisselle & Sklar, LLP

(57) ABSTRACT

The present invention relates to a rehabilitation exercise aid. The exercise aid includes an actuator for extending from a first body part. An alarm unit can be fastened to a second body part and coupled to the actuator. The alarm unit is configured to generate an alarm when the first body part moves beyond a target relative to the second body part. In one embodiment, the actuator includes an elongate biasing means for biasing the alarm unit toward the first body part.

16 Claims, 2 Drawing Sheets

REHABILITATION EXERCISE AID

BACKGROUND

The reference to any prior art in this specification is not, and should not be taken as an acknowledgement or any form of suggestion that the prior art forms part of the common general knowledge.

After an injury or surgery, patients often undertake active range of motion exercises during rehabilitation. These exercises often include movements such as flexion and extension of a first body part relative to a second body part. Flexion decreases the acute angle between the bones of a limb at a joint, whilst extension increases it. For example the elbow is flexed when the hand is brought closer to the shoulder.

Active range of motion exercises are performed and closely supervised by a physiotherapist or nurse initially, and may be. continued by the patient without supervision. These exercises need to be repeated in a consistent manner many times, possibly many hundreds of times, and gradually upgraded over the rehabilitation period. It is important that both patient and therapist are aware that the correct movement is being carried out in any exercise and the desired target amount of movement is or is not being achieved. Providing a clear target and feedback allows the patient to focus on developing and maintaining the required degree of correct movement. It is important that a patient is enabled to carry out many correct exercises without close supervision if the many repeats necessary for good recovery are to be undertaken. In general, therapists simply do not have the time to give every patient close supervision all day and every day of their long rehabilitation process so physiotherapists must divide their time between the individual close supervision of patients and supervising patients at various degrees of distance. Also, during the healing process, certain motion exercises may need to avoid extension or flexion of the first body part relative to the second body part beyond safe targets. Otherwise, the stress induced may re-injure the affected body part or incorrect movements may limit potential progress. Whilst the physiotherapist, or nurse can ensure that the body parts remain within safe targets during therapy, injuries can occur when unsupervised exercises are performed at home or without very close supervision in a gym.

Embodiments of the present invention provide an aid for improving the effectiveness of rehabilitation excises and for correctly performing them without close supervision.

SUMMARY OF THE INVENTION

According to one aspect of the present invention, there is provided a rehabilitation exercise aid including:

an actuator for extending from a first body part; and an alarm unit for fastening to a second body part or object and coupling to the actuator, the alarm unit configured to generate an alarm when the first body part moves beyond a target relative to the second body part or object.

The aid may help a patient to effectively perform a rehabilitation exercise by generating an alarm when the required degree of correct movement between the body parts has been achieved.

The aid may also enable a patient to correctly perform an unsupervised rehabilitation exercise by ceasing movement of the first body part beyond a safe target relative to the second body part or object upon detection of the generated alarm.

Preferably, the actuator includes an elongate biasing means for biasing the alarm unit toward the first body part.

The alarm unit may include a switch having flexion and extension positions (or limits) where the switch changes state. This switch may include a pair of rings fixed relative to the second body part or object, and an insulated conductor terminating in a pair of terminals between which the rings are located and for moving relative to the rings. The terminals may be coupled relative to the actuator. In one embodiment, the aid may include another biasing means so that each terminal is coupled to a respective biasing means.

The alarm unit may further include a mode of operation switch coupled to the rings. This mode of operation switch may be a three position switch with a flexion mode position which activates a first ring of another switch, an extension mode position which activates a second ring of the other switch, and an off position in which both of the rings are inactive. In this embodiment, one or more biasing means allow the other switch to remain in an open state whereby the active rings do not touch corresponding terminals unless the patient moves a body part in a desired manner. The alarm unit may further include a power supply. The power supply may be a battery.

The alarm unit may include an alarm coupled in series with the power supply and three-position switch. Preferably, the alarm is an audible alarm. Alternatively, the alarm may be a visual (e.g. light) or vibrating alarm.

The alarm unit may include a fastening means for fastening the rings relative to the second body part or object. The fastening means may include a pair of straps with hook-and-loop fasteners and for bounding the second body part or object.

The actuator may, in use, include an inextensible link and an extensible link.

The actuator may include:

fastening means including an anchor strap with a hook-and-loop fasteners and for bounding the first body part;

an inextensible cord extending from the fastening means;

a first adjustor for adjusting the effective length of the cord;

an extensible and resilient band for coupling between the cord and the alarm unit; and a second adjustor for adjusting the effective length of the band.

The cord and band may each include graduation markings to facilitate adjustment of their effective lengths.

According to another aspect of the present invention, there is provided a rehabilitation exercise aid including:

an actuator for extending from a first body part;

an electrical component for fastening to a second body part or object and coupling to the actuator so that the component changes properties when the first body part moves beyond a target relative to the second body part or object.

The aid may further include an alarm for generating an alarm responsive to the component changing properties. The component may be a switch which can change states (i.e. properties). The switch may have both flexion and extension positions where the switch changes state.

Alternatively, the component may be a stretchable conductor which changes resistance or conductance (i.e. properties) with length.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
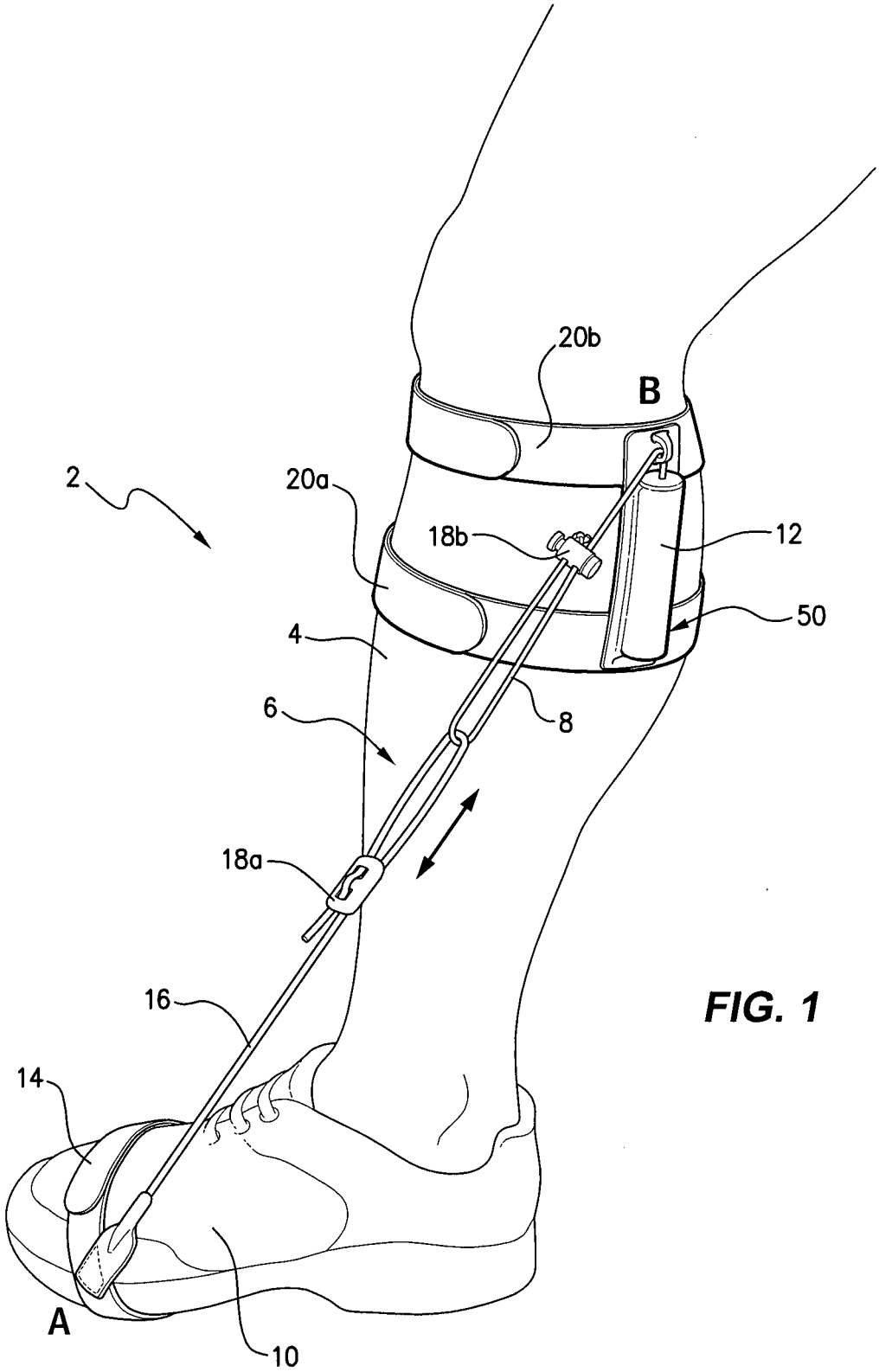
FIG. 1 is a perspective view of a rehabilitation exercise aid worn by a patient in accordance with an embodiment of the present invention.

According to an embodiment of the present invention, there is provided a rehabilitation exercise aid 2 worn by a patient as shown in FIG. 1. The exercise aid 2 includes a actuator 6, which includes a resilient band 8 and is suitable for weakly biasing an alarm unit 12 toward a foot 10. The actuator 6 is a biasing means that can actuate the alarm unit 12. The alarm unit 12 is fastened to a leg 4 and is coupled to the actuator 6. The alarm unit generates an alarm when the foot 10 moves beyond either flexion or extension targets (or limits) relative to the leg 4. The aid 2 enables the patient to safely perform unsupervised rehabilitation exercises by ceasing movement of the foot 10 beyond the flexion or extension targets relative to the leg 4 upon detection of the generated alarm. A detailed description of the aid 2 is provided below.

The actuator 6 includes foot fastening means in the form of an anchor strap 14 with a hook-and-loop fastener (e.g. Velcro™). The strap 14 can bound the foot 10 to anchor the actuator 6. An inextensible cord 16 extends from the anchor strap 14 and a lower adjustor 18*a* is provided for adjusting the effective length of the cord 16. As previously mentioned, the actuator 6 includes the rubber band 8 which is resilient and extensible, and is suitable for coupling between the cord 16 and the alarm unit 12. An upper adjustor 18*b* is also provided for adjusting the effective length of the band 8. The cord 16 and band 8 each include graduation markings, in the form of bands of alternating color, to facilitate adjustment of their effective lengths, and the effective length between points A and B shown in FIG. 1.

The alarm unit 12 includes leg fastening means for securely fastening it to the leg 4. The leg fastening means includes a pair of straps 20*a*, 20*b*, of similar construction to anchor strap 14, with hook-and-loop fasteners and for bounding the leg 4.

Figure 2:
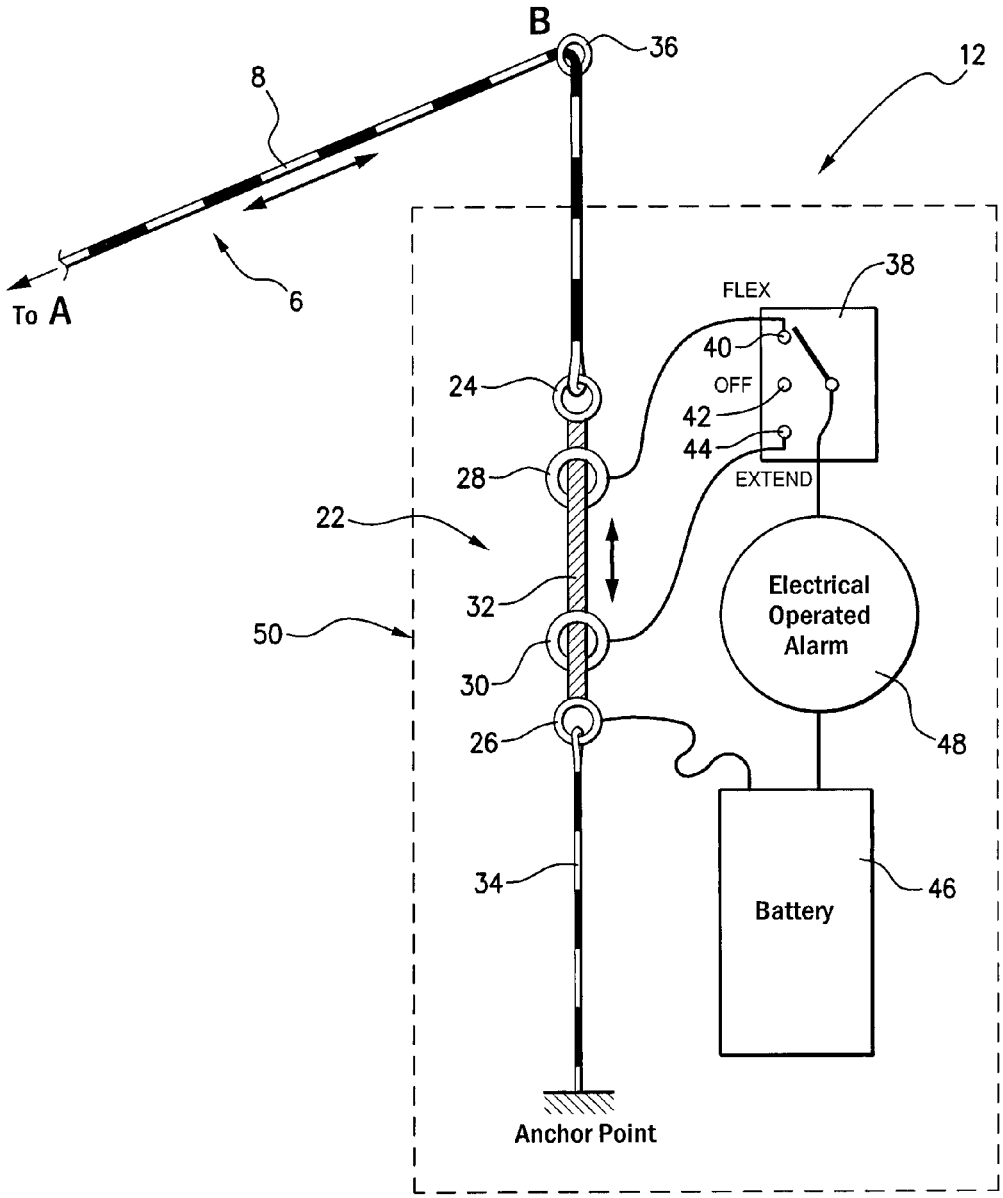
FIG. 2 is a side schematic view of an alarm unit of the rehabilitation exercise aid of FIG. 1.

Turning to. FIG. 2, the alarm unit 2 includes a twitch 22 having a flexion target at an upper terminal 24 and an extension target at a lower terminal 26 where the switch 22 can change state from open to closed. The switch 22 includes a pair of static input rings 28, 30 fixed relative to the leg 4, and an insulated conductor 32 terminating in the terminals 24, 26. The input rings 28, 30 are located between the terminals 24, 26 and the insulated conductor 32 can move relative to the rings 28, 30. The switch 22 is in a closed state when input ring 28 contacts terminal 24 or input ring 30 contacts terminal 26, and is in an open state otherwise.

The upper terminal 24 is coupled to the actuator 6. The aid 2 further includes another biasing means 34, in the form of an elastic band of weaker strength than band 8, for coupling between the lower terminal 26 and a stationary anchor point of the alarm unit 12. In use, both biasing means 6, 34 maintain the switch 22 in the open state whereby the rings 28, 30 (whichever is active) do not touch the terminals 24, 26 unless the patient moves the foot 10 to either increase or decrease tension in the actuator 6 to bring one terminal 24 or 26 into contact with a corresponding active ring 28 or 30. The alarm unit 2 further includes a guide ring 36 which, like the input rings 28, 30, is stationary in use. The elastic band 8 of the actuator 6 passes through the guide ring 36 prior to connection to the upper terminal 24 of the insulated conductor 32.

The alarm unit 12 further includes a mode-of-operation switch 38 coupled to the rings 28, 30. The mode of operation switch 38 is a three-position switch with a flexion mode position 40, an off mode position 42 and an extension mode position 44. The alarm unit 2 further includes a power supply 46 in the form of a battery. In addition, the alarm unit 2 includes an audible piezoelectric alarm 48 coupled in series with the power supply 46 and switch 38.

In use, the patient attaches the exercise aid 2 to the leg 4 and foot 10 as shown in FIG. 1. The straps 20*a*, 20*b* are fastened to the leg 4 and the anchor strap 14 is fastened to the foot 10. The elastic band 8 does not move the foot 10 or provide significant resistance to the movement of the foot 10. Instead, the elastic band 8 maintains the actuator 6 under tension when the foot moves to or beyond the target position away from the alarm unit 12 without unduly restricting the freedom of movement of the foot 10.

Next, the mode-of-operation switch 38 is set so that, either the patient will trigger the alarm 48 by extending the foot 10 to increase the distance from the anchor location A to the alarm unit B to more than a predetermined target (extension mode) or by flexing the foot 10 to reduce the distance from the anchor location A to the alarm unit B to less than a predetermined target (flexion mode). The effective length of the actuator 6 is then adjusted so that the alarm 48 is triggered at the desired predetermined target by adjusting the inextensible link 16. The range of motion beyond that necessary to trigger the alarm 48 may be adjusted by changing the effective length of the extensible link 8 so that the patient can extend further beyond the set target without damage or disruption to the aid 2.

When the mode-of-operation switch 38 is set to the flexion mode position 40, the patient can repeatedly flex the foot 10 toward the leg 4 thereby decreasing the distance between points A and B. If the foot 10 is flexed beyond the set flexion target, the upper terminal 24 and input ring 28 make contact and close the circuit including the insulated conductor 32, switch 38, alarm 48 and power supply 46, thereby causing the alarm 48 to sound.

Alternatively, when the mode-of-operation switch 38 is set to the extension mode position 44, the patient can repeatedly extend the foot 10 away from the leg 4 thereby increasing the distance between points A and B. If the foot 10 is extended beyond the extension target, the lower terminal 26 and input ring 30 make contact and close the circuit including the switch 38, alarm 48 and power supply 46, thereby causing the alarm 48 to sound.

The compliance of the actuator 6 prevents damage to the alarm unit 2 in the event of excessive flexion or extension of the foot 10.

Upon exercise completion, the straps 14, 20*a*, 20*b* which are typically formed of rubber can be removed and wiped clean for use by another patient.

The aid 2 enables the patient to repeat rehabilitation, exercises correctly, irrespective of whether a therapist is present. The target range of motion signaled by the aid 2 can be varied, and increased as the patient recovers.

A person skilled in the art will appreciate that many embodiments and variations can be made without departing from the ambit of the present invention.

The preferred embodiment was described with reference to an exercise aid 2 fitted to a patient's leg 4 and foot 10. The exercise aid 2 can be readily fitted to other body parts including, for example, a hand and an arm.

The exercise aid 2 of the preferred embodiment included an audible alarm 48. In another embodiment, the alarm 24 may instead be a visual (e.g. light) or vibrating alarm.

In the preferred embodiment, the exercise aid 2 was self-contained and portable. In this manner, the limit switch 22, the mode-of-operation switch 38, alarm 48 and power supply 46 were all contained within a compact housing 50 (or chassis) normally but not necessarily borne by the patient. The rings 28, 30, 36 and fixed end of the biasing means 34 were all affixed to the housing 50. In an alternative embodiment, the actuator 6 and limit switch 22 may be borne by the patient whereas the mode-of-operation switch 38, alarm 48 and power supply 46 are contained within a housing not borne by the patient.

In the preferred embodiment, the alarm unit 12 included a limit switch 22 which was able to change state (i.e. electrical properties) responsive to flexion and extension of body parts. In an alternative embodiment, the limit switch 22 may be replaced by an arrangement including an alternative electrical component for coupling to the actuator 6 so that the electrical component changes properties as relative motion of body parts exceeds a target. In this case, the aid further includes an alarm for generating an alarm responsive to the component changing properties. The electrical component may, for example, be a stretchable spring which changes resistance or conductance (i.e. properties) with varying length.

In one embodiment, elastic bands 8, 34 can be replaced by springs.

In the preferred embodiment, the mode-of-operation switch 38 has a flexion mode position 40 and extension mode position 44 which could be alternatively selected for flexion and extension exercises respectively. In an alternative embodiment, the input rings 28, 30 could instead bypass the switch 38 and be both connected directly to the alarm 48 so that the alarm is generated upon both flexion and extension of the foot 10 beyond respective safe targets, In a further embodiment, an additional switch may be incorporated to allow the aid 2 to be active only when a body part is either: in motion (or accelerating); or static. An example of the use of this embodiment would be as an aid to improving foot aversion when walking when the alarm 48 would only sound either when the leg is in stance phase (therefore nearly static) or when the leg is in swing phase (therefore in forward motion).

In one embodiment, the exercise aid may include a counter for counting the number of flexion or extension repetitions.

In the preferred embodiment, the alarm unit 12 was fastened to a body part. In another embodiment, the alarm unit 12 may instead be fastened to a fixed object such as a bed frame or wall rail.

In compliance with the statute, the invention has been described in language more or less specific to structural or methodical features. It is to be understood that the invention is not targeted to specific features shown or described since the means herein described comprises preferred forms of putting the invention into effect. The invention is, therefore, claimed in any of its forms or modifications within the proper scope of the appended claims appropriately interpreted by those skilled in the art.

The claims defining the invention are as follows:

1. A rehabilitation exercise aid including:

an actuator for extending from a first body part; and an alarm unit for fastening to a second body part or object and coupling to the actuator, the alarm unit configured to generate an alarm in response to the first body part moving unaided beyond a target relative to the second body part or object, wherein the actuator includes an inextensible link and an extensible link.

2. An exercise aid as claimed in claim 1, wherein the actuator includes an elongate biasing means for biasing the alarm unit toward the first body part.

3. An exercise aid as claimed in claim 1, wherein the alarm unit includes a switch having flexion and extension positions or limits where the switch changes state.

4. An exercise aid as claimed in claim 3, wherein the switch includes a pair of rings fixed relative to the second body part or object, and an insulated conductor terminating in a pair of terminals between which the rings are located and for moving relative to the rings.

5. An exercise aid as claimed in claim 4, further including another biasing means so that each terminal is coupled to a respective biasing means.

6. An exercise aid as claimed in claim 4, further including a mode of operation switch coupled to the rings.

7. An exercise aid as claimed in claim 6, wherein the mode of operation switch is a three position switch with a flexion mode position which activates a first ring of the other switch, an extension mode position which activates a second ring of the other switch, and an off position in which both of the rings are inactive.

8. An exercise aid as claimed in claim 7, wherein one or more biasing means can allow the other switch to remain in an open state whereby the active rings do not touch corresponding terminals.

9. An exercise aid as claimed in claim 1, wherein the alarm unit includes a power supply in the form of a battery.

10. An exercise aid as claimed in claim 9, wherein the alarm unit further includes an alarm coupled in series with the power supply and a switch.

11. An exercise aid as claimed in claim 10, wherein the alarm is an audible alarm, a visual alarm or a vibrating alarm.

12. An exercise aid as claimed in claim 1, wherein the alarm unit includes fastening means for fastening rings relative to the second body part or object.

13. An exercise aid as claimed in claim 12, wherein the fastening means includes a pair of straps with hook-and-loop fasteners, the straps able to bound the second body part or object.

14. An exercise aid as claimed in claim 1, wherein the actuator includes:

fastening means including an anchor strap with a hook-and-loop fasteners and for bounding the first body part;

an inextensible cord extending from the fastening means;

a first adjustor for adjusting the effective length of the cord;

an extensible and resilient band for coupling between the cord and the alarm unit; and a second adjustor for adjusting the effective length of the band.

15. An exercise aid as claimed in claim 14, wherein the cord and band each include graduation markings to facilitate adjustment of their effective lengths.

16. An exercise aid as claimed in claim 1, further including a counter for counting flexion or extension repetitions.

* * * * *